US012203201B2

(12) United States Patent
Hu et al.

(10) Patent No.: US 12,203,201 B2
(45) Date of Patent: Jan. 21, 2025

(54) METHODS FOR SUGGESTING OPERATION OF A WASHING MACHINE APPLIANCE

(71) Applicant: Haier US Appliance Solutions, Inc., Wilmington, DE (US)

(72) Inventors: Haitian Hu, Louisville, KY (US); Hairong Li, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 172 days.

(21) Appl. No.: 17/986,062

(22) Filed: Nov. 14, 2022

(65) Prior Publication Data

US 2024/0158976 A1 May 16, 2024

(51) Int. Cl.

| | |
|---|---|
| ***D06F 34/04*** | (2020.01) |
| ***D06F 23/02*** | (2006.01) |
| ***D06F 33/32*** | (2020.01) |
| ***D06F 34/18*** | (2020.01) |
| ***D06F 34/28*** | (2020.01) |

(Continued)

(52) U.S. Cl.

CPC ..... *D06F 34/04* (2020.02); *D06F 23/02* (2013.01); *D06F 33/32* (2020.02); *D06F 34/18* (2020.02); *D06F 34/28* (2020.02); *D06F 33/30* (2020.02); *D06F 2101/00* (2020.02); *D06F 2103/04* (2020.02); *D06F 2103/38* (2020.02); *D06F 2103/68* (2020.02); *D06F 2105/58* (2020.02)

(58) Field of Classification Search

CPC ..... D06F 34/04; D06F 23/02; D06F 34/18; D06F 33/32; D06F 33/30; D06F 34/28; D06F 2103/38; D06F 2103/68; D06F 2101/00; D06F 2105/58; D06F 2103/04; D06F 34/05

See application file for complete search history.

(56) References Cited

U.S. PATENT DOCUMENTS

2012/0144601 A1* 6/2012 Ghosh ..... D06F 25/00 8/137
2019/0169780 A1* 6/2019 Chen ..... G05B 19/0426

(Continued)

FOREIGN PATENT DOCUMENTS

CA 2166526 C 8/2004
CN 110607639 A 12/2019

(Continued)

OTHER PUBLICATIONS

Machine Translation of CN-111066289-A to Jang, Apr. 2020. (Year: 2020).*

(Continued)

*Primary Examiner* — Benjamin L Osterhout
(74) *Attorney, Agent, or Firm* — Dority & Manning, P.A.

(57) ABSTRACT

A method of operating a washing machine appliance. The washing machine appliance is configured for communication with an external device. The method includes monitoring, from the external device, a new wash cycle activation. The method also includes measuring a load weight of the washing machine appliance and identifying a time of day of the new wash cycle activation. The method further includes comparing a cycle history of the washing machine appliance to the new wash cycle activation and suggesting an operation mode of the washing machine appliance in response to the load weight, the time of day, and the cycle history.

20 Claims, 6 Drawing Sheets

(51) Int. Cl.

| | |
|---|---|
| *D06F 33/30* | (2020.01) |
| *D06F 101/00* | (2020.01) |
| *D06F 103/04* | (2020.01) |
| *D06F 103/38* | (2020.01) |
| *D06F 103/68* | (2020.01) |
| *D06F 105/58* | (2020.01) |

(56) References Cited

U.S. PATENT DOCUMENTS

| | | | | |
|---|---|---|---|---|
| 2021/0108351 | A1* | 4/2021 | Patterson | D06F 33/30 |
| 2024/0117547 | A1* | 4/2024 | Hu | D06F 33/68 |

FOREIGN PATENT DOCUMENTS

| | | | | | |
|---|---|---|---|---|---|
| CN | 110938969 | A | | 3/2020 | |
| CN | 111066289 | A | * | 4/2020 | H04L 12/28 |
| CN | 112323343 | A | | 2/2021 | |
| CN | 114000306 | A | * | 2/2022 | |
| JP | 2008243088 | A | | 10/2008 | |
| KR | 20230103552 | A | * | 7/2023 | |
| WO | WO-2010054991 | A1 | * | 5/2010 | G01R 22/10 |

OTHER PUBLICATIONS

Machine Translation of CN-114000306-A to Chen, Feb. 2022. (Year: 2022).*
Machine Translation of KR20230103552 A to Woo et al., Jul. 2023. (Year: 2023).*
Machine Translation of WO-2010054991-A1 to Botts, May 2010. (Year: 2010).*

* cited by examiner

METHODS FOR SUGGESTING OPERATION OF A WASHING MACHINE APPLIANCE

FIELD OF THE INVENTION

The present subject matter relates generally to methods to suggest operation of a washing machine appliance to a user.

BACKGROUND OF THE INVENTION

Washing machine appliances generally include a wash tub for containing water or wash fluid (e.g., water, detergent, bleach, or other wash additives). A basket is rotatably mounted within the wash tub and defines a wash chamber for receipt of articles for washing. During normal operation of such washing machine appliances, the wash fluid is directed into the wash tub and onto articles within the wash chamber of the basket. The basket or an agitation element can rotate at various speeds to agitate articles within the wash chamber, to wring wash fluid from articles within the wash chamber, etc.

Some existing washing machine appliances, such as horizontal axis washing machines, are provided with one or more ventilation features. Further, some existing washing machines are equipped to dry articles in the appliance as well. In order to effectively dry articles in the appliance, the moisture from the wash cycle must be removed from the basket. Thus, drain pumps traditionally operate to reduce the moisture from accumulating within the tub. Additionally, such features may allow a washing machine appliance to exchange air between the wash tub and the ambient environment. However, using these features is not always intuitive to users.

BRIEF DESCRIPTION OF THE INVENTION

Aspects and advantages of the invention will be set forth in part in the following description, or may be apparent from the description, or may be learned through practice of the invention.

In one example embodiment, a method of operating a washing machine appliance. The washing machine appliance is configured for communication with an external device. The method includes monitoring, from the external device, a new wash cycle activation. The method also includes measuring a load weight of the washing machine appliance and identifying a time of day of the new wash cycle activation. The method further includes comparing a cycle history of the washing machine appliance to the new wash cycle activation and suggesting an operation mode of the washing machine appliance in response to the load weight, the time of day, and the cycle history.

In another example embodiment, a method of operating a washing machine appliance. The washing machine includes a controller that is configured for signal communication with an external device. The method includes monitoring, by a controller, a new wash cycle activation, and measuring, by the controller, a load weight of the washing machine appliance. The method also includes identifying, by the external device, a time of day of the new wash cycle activation, and comparing, by the external device, a cycle history of the washing machine appliance to the new wash cycle activation. The method further includes suggesting, by the external device, an operation mode of the washing machine appliance in response to the load weight, the time of day, and the cycle history.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
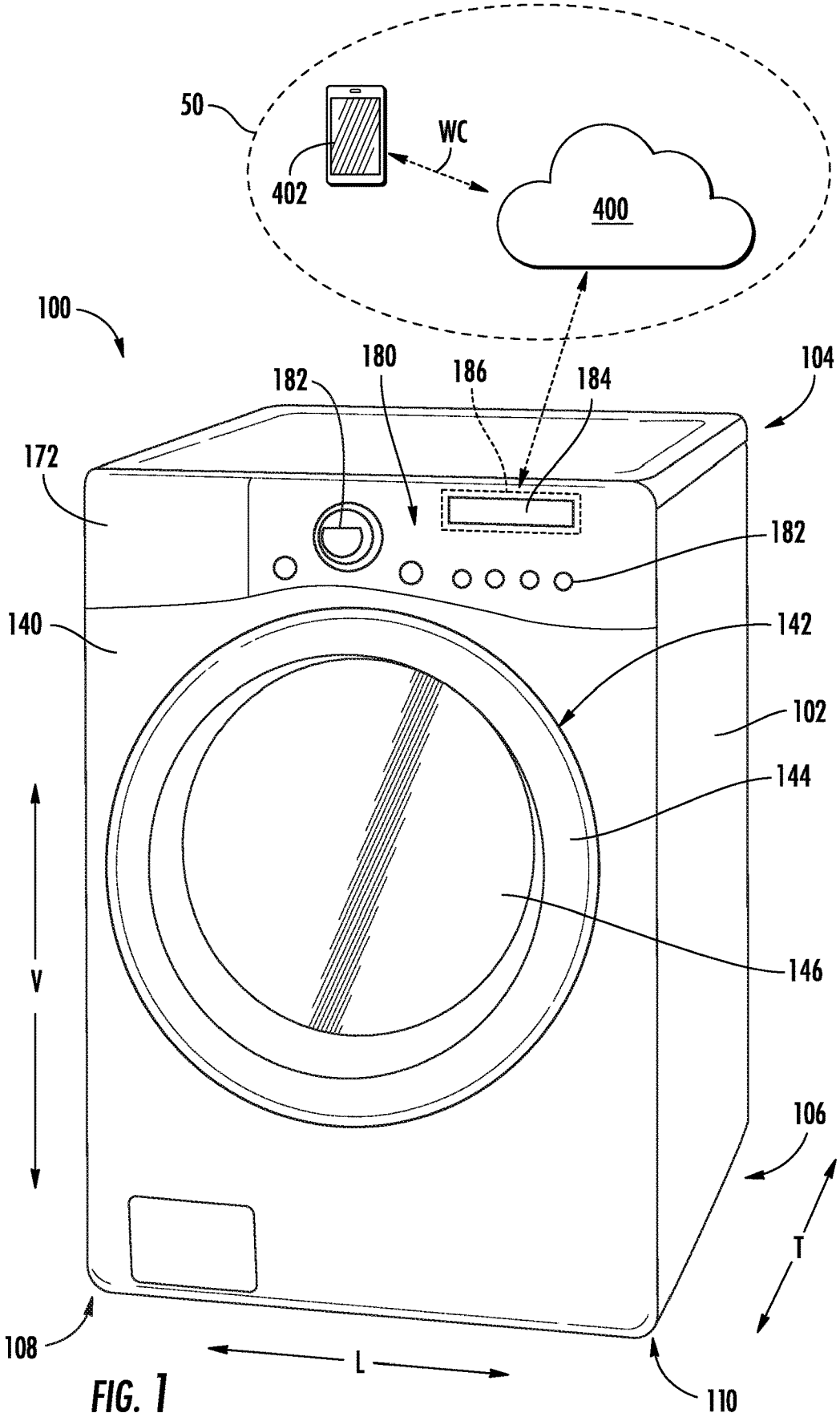
FIG. 1 provides a perspective view of a washing machine appliance according to one or more example embodiments of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one element from another and are not intended to signify location or importance of the individual elements. Terms such as "inner" and "outer" refer to relative directions with respect to the interior and exterior of the washing machine appliance, and in particular the wash basket therein. For example, "inner" or "inward" refers to the direction towards the interior of the washing machine appliance. Terms such as "left," "right," "front," "back,"

"top," or "bottom" are used with reference to the perspective of a user accessing the washing machine appliance. For example, a user stands in front of the washing machine appliance to open the door and reaches into the wash basket to access items therein. Furthermore, it should be appreciated that as used herein, terms of approximation, such as "approximately," "substantially," or "about," refer to being within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
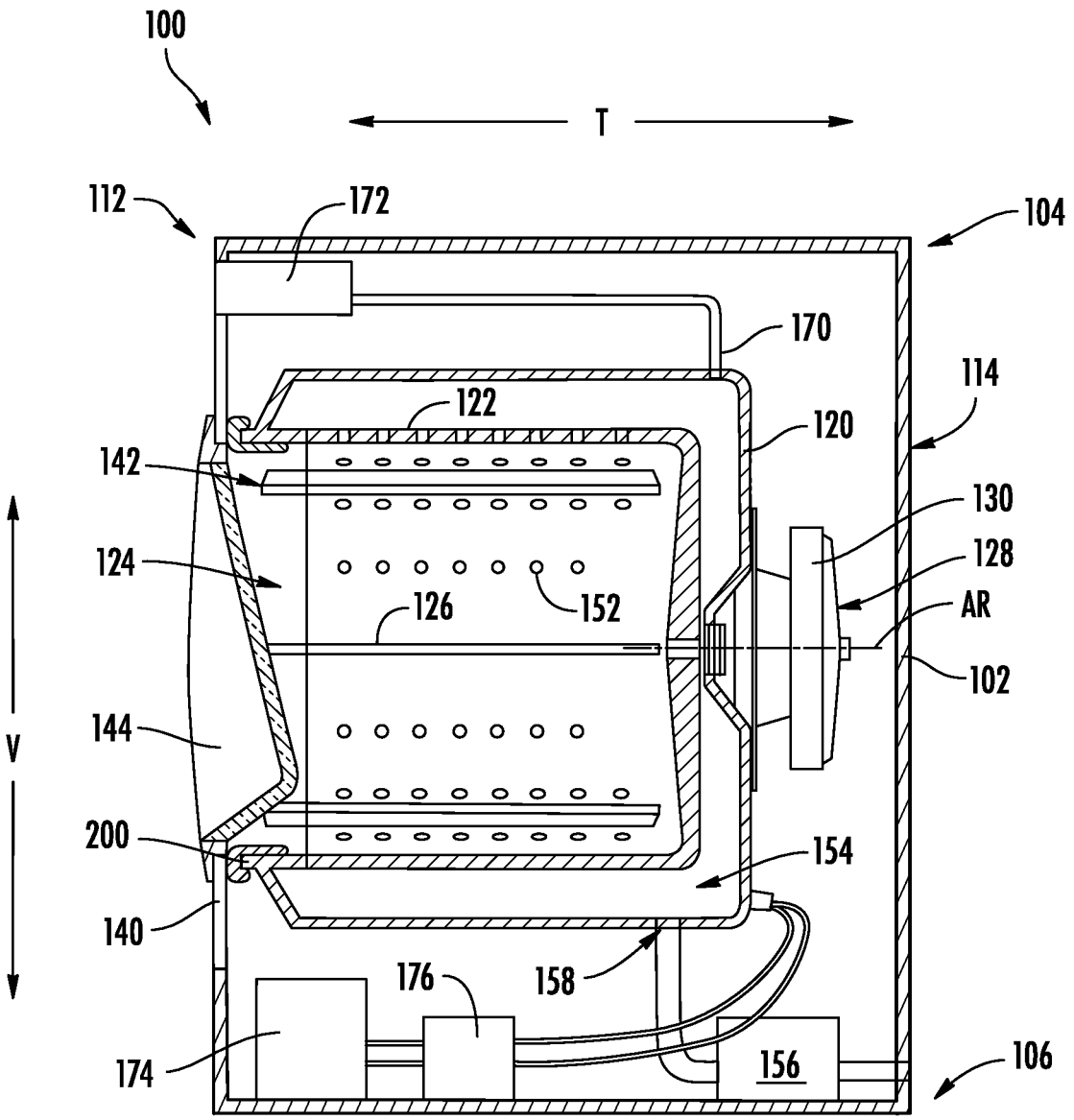
FIG. 2 provides a cross-sectional side view of the example washing machine appliance.

Referring now to the figures, FIG. 1 is a perspective view of an example horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction L, and between a front 112 and a rear 114 along the transverse direction T.

Referring to FIG. 2, a wash tub 120 is positioned within cabinet 102 and is generally configured for retaining wash fluids during an operating cycle. As used herein, "wash fluid" may refer to water, detergent, fabric softener, bleach, or any other suitable wash additive or combination thereof. A wash basket 122 is received within wash tub 120 and defines a wash chamber 124 that is configured for receipt of articles for washing. More specifically, wash basket 122 is rotatably mounted within wash tub 120 such that it is rotatable about an axis of rotation AR. According to the illustrated embodiment, the axis of rotation is substantially parallel to the transverse direction T. In this regard, washing machine appliance 100 is generally referred to as a "horizontal axis" or "front load" washing machine appliance 100. However, it should be appreciated that aspects of the present subject matter may be used within the context of a vertical axis or top load washing machine appliance as well.

Wash basket 122 may define one or more agitator features that extend into wash chamber 124 to assist in agitation and cleaning articles disposed within wash chamber 124 during operation of washing machine appliance 100. For example, as illustrated in FIG. 2, a plurality of ribs 126 extends from basket 122 into wash chamber 124. In this manner, for example, ribs 126 may lift articles disposed in wash basket 122 during rotation of wash basket 122.

Washing machine appliance 100 includes a drive assembly 128 which is coupled to wash tub 120 and is generally configured for rotating wash basket 122 during operation, e.g., such as during an agitation or spin cycle. More specifically, as best illustrated in FIG. 2, drive assembly 128 may include a motor assembly 130 that is in mechanical communication with wash basket 122 to selectively rotate wash basket 122 (e.g., during an agitation or a rinse cycle of washing machine appliance 100). According to the illustrated embodiment, motor assembly 130 is a pancake motor. However, it should be appreciated that any suitable type, size, or configuration of motors may be used to rotate wash basket 122 according to alternative embodiments. In addition, drive assembly 128 may include any other suitable number, types, and configurations of support bearings or drive mechanisms.

Referring generally to FIGS. 1 and 2, cabinet 102 also includes a front panel 140 that defines an opening 142 that permits user access to wash basket 122. More specifically, washing machine appliance 100 includes a door 144 that is positioned over opening 142 and is rotatably, e.g., pivotably, mounted to front panel 140 (e.g., about a door axis that is substantially parallel to the vertical direction V). In this manner, door 144 permits selective access to opening 142 by being movable between an open position (not shown) facilitating access to a wash tub 120 and a closed position (FIG. 1) prohibiting access to wash tub 120. For example, when the door 144 is in the closed position, the wash tub 120 may be generally enclosed (e.g., at least 90% enclosed and at least 90% surrounded on all sides, such as fully enclosed with the exception of a vent line 190 and/or vent aperture 202 as will be described below) by the door 144 and the cabinet 102. A gasket 200 may be provided in the opening 142 and the gasket 200 may sealingly engage the door 144 when the door 144 is in the closed position. For example, the gasket 200 may extend between the tub 120 and the front panel 140, e.g., generally along the transverse direction T and may extend about or around the opening 142 such that the gasket 200 is covered by the door 144 when the door 144 is in the closed position, and the gasket 200 may promote sealing between the door 144 and the cabinet 102, e.g., the front panel 140 of the cabinet 102.

In some embodiments, a window 146 in door 144 permits viewing of wash basket 122 when door 144 is in the closed position (e.g., during operation of washing machine appliance 100). Door 144 also includes a handle (not shown) that, for example, a user may pull when opening and closing door 144. Further, although door 144 is illustrated as mounted to front panel 140, it should be appreciated that door 144 may be mounted to another side of cabinet 102 or any other suitable support according to alternative embodiments.

Referring again to FIG. 2, wash basket 122 also defines a plurality of perforations 152 in order to facilitate fluid communication between an interior of basket 122 and wash tub 120. A sump 154 is defined by wash tub 120 at a bottom of wash tub 120 along the vertical direction V. Thus, sump 154 is configured for receipt of, and generally collects, wash fluid during operation of washing machine appliance 100. For example, during operation of washing machine appliance 100, wash fluid may be urged (e.g., by gravity) from basket 122 to sump 154 through the plurality of perforations 152. A pump assembly 156 is located beneath wash tub 120 for gravity assisted flow when draining wash tub 120 (e.g., via a drain 158). Pump assembly 156 is also configured for recirculating wash fluid within wash tub 120. Accordingly, pump assembly 156 may also be referred to or include a drain pump and/or a circulation pump.

Referring still to FIGS. 1 and 2, in some embodiments, washing machine appliance 100 may include an additive dispenser or spout 170. For example, spout 170 may be in fluid communication with a water supply (not shown) in order to direct fluid (e.g., clean water) into wash tub 120. Spout 170 may also be in fluid communication with the sump 154. For example, pump assembly 156 may direct wash fluid disposed in sump 154 to spout 170 in order to circulate wash fluid in wash tub 120.

As illustrated, a detergent drawer 172 may be slidably mounted within front panel 140. Detergent drawer 172 receives a wash additive (e.g., detergent, fabric softener, bleach, or any other suitable liquid or powder) and directs the fluid additive to wash chamber 124 during operation of washing machine appliance 100. According to the illustrated embodiment, detergent drawer 172 may also be fluidly coupled to spout 170 to facilitate the complete and accurate dispensing of wash additive.

In some embodiments, an optional bulk reservoir 174 may be disposed within cabinet 102. Bulk reservoir 174 may be configured for receipt of fluid additive for use during operation of washing machine appliance 100. Moreover, bulk reservoir 174 may be sized such that a volume of fluid additive sufficient for a plurality or multitude of wash cycles of washing machine appliance 100 (e.g., five, ten, twenty, fifty, or any other suitable number of wash cycles) may fill bulk reservoir 174. Thus, for example, a user can fill bulk reservoir 174 with fluid additive and operate washing machine appliance 100 for a plurality of wash cycles without refilling bulk reservoir 174 with fluid additive. A reservoir pump 176 may be configured for selective delivery of the fluid additive from bulk reservoir 174 to wash tub 120.

A control panel 180 including a plurality of input selectors 182 may be coupled to front panel 140. Control panel 180 and input selectors 182 collectively form a user interface input for operator selection of machine cycles and features. A display 184 of control panel 180 indicates selected features, operation mode, a countdown timer, and/or other items of interest to appliance users regarding operation.

Operation of washing machine appliance 100 is controlled by a processing device or a controller 186 that is operatively coupled to control panel 180 for user manipulation to select washing machine cycles and features. In response to user manipulation of control panel 180, controller 186 operates the various components of washing machine appliance 100 to execute selected machine cycles and features. Controller 186 may include a memory and microprocessor, such as a general or special purpose microprocessor operable to execute programming instructions or micro-control code associated with methods described herein. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 186 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 180 may be in communication with controller 186 via one or more signal lines or shared communication busses to provide signals to and/or receive signals from the controller 186.

In addition, the memory or memory devices of the controller 186 can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 186 may be operable to execute programming instructions or micro-control code associated with an operating cycle of washing machine appliance 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 186 as disclosed herein is capable of and may be operable to perform any methods, method steps, or portions of methods as disclosed herein. For example, in some embodiments, methods disclosed herein may be embodied in programming instructions stored in the memory and executed by controller 186.

The memory devices may also store data that can be retrieved, manipulated, created, or stored by the one or more processors or portions of controller 186. The data can include, for instance, data to facilitate performance of methods described herein. The data can be stored locally (e.g., on controller 186) in one or more databases and/or may be split up so that the data is stored in multiple locations. In addition, or alternatively, the one or more database(s) can be connected to controller 186 through any suitable network(s), e.g., network WC, such as through a high bandwidth local area network (LAN) or wide area network (WAN). In this regard, for example, controller 186 may further include a communication module or interface that may be used to communicate with one or more other component(s) of washing machine appliance 100, controller 186, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

In example embodiments, during operation of washing machine appliance 100, laundry items are loaded into wash basket 122 through opening 142, and a wash operation is initiated through operator manipulation of input selectors 182. For example, a wash cycle may be initiated such that wash tub 120 is filled with water, detergent, or other fluid additives (e.g., via detergent drawer 172 or bulk reservoir 174). One or more valves (not shown) can be controlled by washing machine appliance 100 to provide for filling wash basket 122 to the appropriate level for the amount of articles being washed or rinsed. By way of example, once wash basket 122 is properly filled with fluid, the contents of wash basket 122 can be agitated (e.g., with ribs 126) for an agitation phase of laundry items in wash basket 122. During the agitation phase, the basket 122 may be motivated about the axis of rotation AR at a set speed (e.g., first speed or tumble speed). As the basket 122 is rotated, articles within the basket 122 may be lifted and permitted to drop therein.

After the agitation phase of the washing operation is completed, wash tub 120 can be drained, e.g., by drain pump assembly 156. Operation of drain pump assembly will be described further below. Laundry articles can then be rinsed (e.g., through a rinse cycle) by again adding fluid to wash tub 120, depending on the particulars of the cleaning cycle selected by a user. Ribs 126 may again provide agitation within wash basket 122. One or more spin cycles may also be used. In particular, a spin cycle may be applied after the wash cycle or after the rinse cycle in order to wring wash fluid from the articles being washed. During a spin cycle, basket 122 is rotated at relatively high speeds. For instance, basket 122 may be rotated at one set speed (e.g., second speed or pre-plaster speed) before being rotated at another set speed (e.g., third speed or plaster speed). As would be understood, the pre-plaster speed may be greater than the tumble speed and the plaster speed may be greater than the pre-plaster speed. Moreover, agitation or tumbling of articles may be reduced as basket 122 increases its rotational velocity such that the plaster speed maintains the articles at a generally fixed position relative to basket 122. After articles disposed in wash basket 122 are cleaned (or the washing operation otherwise ends), a user can remove the articles from wash basket 122 (e.g., by opening door 144 and reaching into wash basket 122 through opening 142).

During such operations, the gasket 200 may help to contain wash fluid within the cabinet 102, particularly within the tub 120. As generally shown in FIG. 2, the gasket 200 may be positioned between the door 144 and the tub 120, e.g., when the door 144 is in the closed position as in FIG. 2. Thus, the gasket 200 may sealingly engage the door 144 when the door 144 is in the closed position. In general, the gasket 200 sealingly engages the cabinet 102, in particular the opening 142 thereof, the tub 120, and the door 144. For example, the gasket 200 may extend around the opening 142 along a perimeter, e.g., circumference, of the opening 142 and may extend between the cabinet 102 and the wash tub 120 along a longitudinal axis, such as along or generally parallel to the transverse direction T.

After completion of the wash cycle, as described above, moisture can become trapped within the washing machine appliance 100, e.g., in wash tub 120 and/or gasket 200. This may promote growth and/or spread of odors, mold, and/or mildew on the components of washing machine appliance 100 and on the laundry articles within wash basket 122. Accordingly, in accordance with example aspects of the present disclosure, after or between such wash cycles, washing machine appliance 100 may be operated in a ventilation cycle to remove moisture from within the washing machine appliance 100.

It should be appreciated that the present subject matter is not limited to any particular style, model, or configuration of washing machine appliance. The example embodiment depicted in FIGS. 1 and 2 is simply provided for illustrative purposes only. While described in the context of a specific embodiment of horizontal axis washing machine appliance 100, it will be understood that horizontal axis washing machine appliance 100 is provided by way of example only. Other washing machine appliances having different configurations, different appearances, and/or different features may also be utilized with the present subject matter as well. For example, different locations may be provided for the user interface, different configurations may be provided, e.g., vertical axis washing machines, and other differences may be applied as well.

Figure 3:
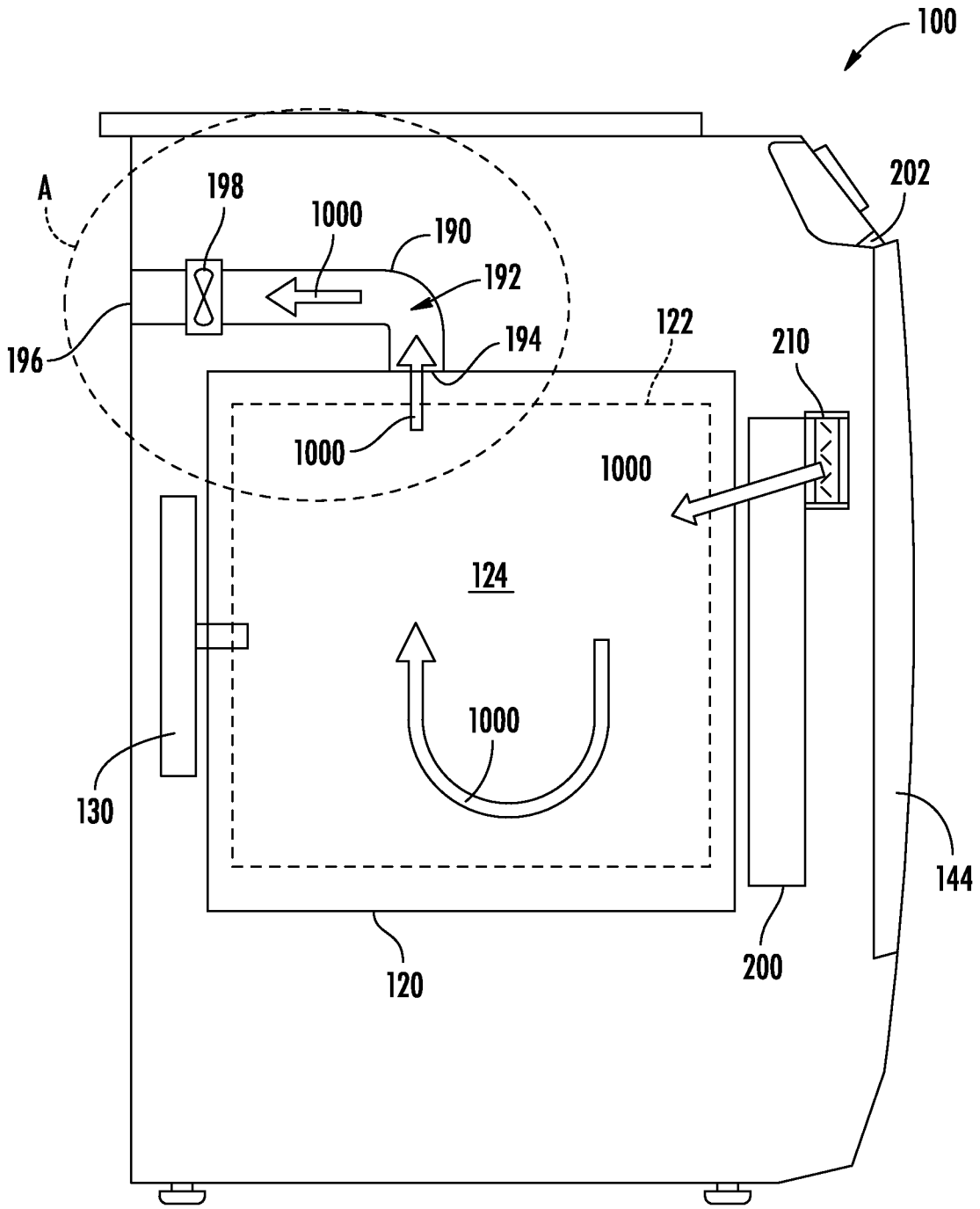
FIG. 3 provides a schematic side view of an example washing machine appliance according to one or more example embodiments of the present disclosure.

As illustrated in FIG. 3, in some embodiments, a ventilation line 190 is provided within washing machine appliance 100. In particular, ventilation line 190 may be enclosed within cabinet 102. As shown in FIG. 3, example embodiments include ventilation line 190 at a position in fluid communication between tub 120 and the surrounding region (e.g., the ambient environment outside of or immediately surrounding cabinet 102, the enclosed volume of cabinet 102 surrounding tub 120, etc.). Generally, it is understood that ventilation line 190 may be provided as any suitable pipe or conduit (e.g., having non-permeable wall) for directing air therethrough. When assembled, ventilation line 190 defines an air path 192 from tub 120 and within or through cabinet 102 (e.g., to the ambient environment outside of cabinet 102). Specifically, air path 192 extends from a ventilation inlet 194, through cabinet 102, and to a ventilation outlet 196. In some embodiments, ventilation inlet 194 is defined through a top portion of wash tub 120 and ventilation outlet 196 is defined through an upper portion of cabinet 102. Thus, air path 192 may extend from the top portion of tub 120 to an upper portion of cabinet 102. Optionally, ventilation inlet 194 may be positioned below ventilation outlet 196 along a vertical direction V. Advantageously, a convective airflow may be naturally motivated from wash tub 120, through air path 192, and to the ambient environment. Also, such airflow may be aided or urged through the washing machine appliance 100 by rotating the wash basket 122. Additionally or alternatively, splashing of wash fluid and the collection of moisture within air path 192 may be prevented. However, any other suitable configuration may be provided to facilitate the flow of air from tub 120 and, for example, to the ambient environment.

Although a convective airflow may be facilitated, additional example embodiments may further include a fan or blower 198. Specifically, fan 198 may be provided in fluid communication with ventilation line 190 to motivate an active airflow therethrough. For instance, fan 198 may be mounted within ventilation line 190 to selectively rotate and draw air from wash tub 120, through ventilation inlet 194, and to ventilation outlet 196, e.g., to output an airflow from tub 120 to the ambient environment.

A cabinet aperture 202 may be defined through front panel 140 as an inlet for ambient air to flow from outside of the cabinet 102 to the inside of the cabinet 102, e.g., to and through the tub 120. Notably, in the disclosed embodiments, air 1000 (e.g., an ambient airflow) may flow between tub 120 and the ambient environment through cabinet aperture 202 and/or vent line 190 even while door 144 remains closed.

A vent damper 210 may be provided to selectively control an airflow between tub 120 and, for example, the ambient environment. Generally, vent damper 210 is in communication with wash tub 120 and/or ventilation line 190 (i.e., in fluid communication with air path 192). In certain embodiments, vent damper 210 is enclosed, at least in part, within cabinet 102. Vent damper 210 may be selectively controlled or operated to limit or obstruct the flow of air from the ambient environment into the interior of the cabinet 102, such as to the wash tub 120, via the aperture 202 during certain operations, phases, or cycles. Thus, vent damper 210 may selectively limit airflow between tub 120 and the ambient environment, such as airflow from the ambient environment via the aperture 202.

The damper 210 may be positioned downstream of the aperture 202, e.g., between the aperture 202 and the wash tub 120 and/or between the aperture 202 and the gasket 200. Thus, opening the damper 210 may permit fluid communication, e.g., air flow, between internal components of the washing machine appliance 100, e.g., the wash tub 120 and/or the wash basket 122, and the ambient environment external to the cabinet 102. Thus, the damper 210 may be upstream of the internal components, e.g., wash basket 122, with respect to a flow of ambient air 1000 from the ambient environment external to the cabinet 102 through the washing machine appliance 100. As may be seen in FIG. 3, the flow of ambient air 1000 from the ambient environment external to the cabinet 102 through the washing machine appliance 100 may enter the washing machine appliance 100 through the aperture 202, flow through the damper 210, into and through the wash tub 120, e.g., wash basket 122 and wash chamber 124 therein, and may exit the washing machine appliance 100 via the vent line 190, e.g., by flowing into the vent line 190 at the ventilation inlet 194 from the wash tub 120, flowing through the vent line 190, and returning to the ambient environment from the vent line 190 via the ventilation outlet 196. In some embodiments, such air flow may be aided or urged by fan 198.

In additional embodiments, the air flow through the washing machine appliance 100, as illustrated by arrows 1000, may be provided by convective flow and/or rotation of the wash basket 122 without the use or presence of a fan.

Such rotation of the wash basket 122, including the ribs 126 therein, may push the air 1000 around to promote circulation of the ambient air 1000 through the washing machine appliance 100, e.g., into and through the wash basket 122. In some embodiments, the fan 198 may not be included, and the flow of ambient air 1000 through the washing machine appliance 100 may be provided solely by natural convection and/or rotation of the wash basket 122.

Figure 4:
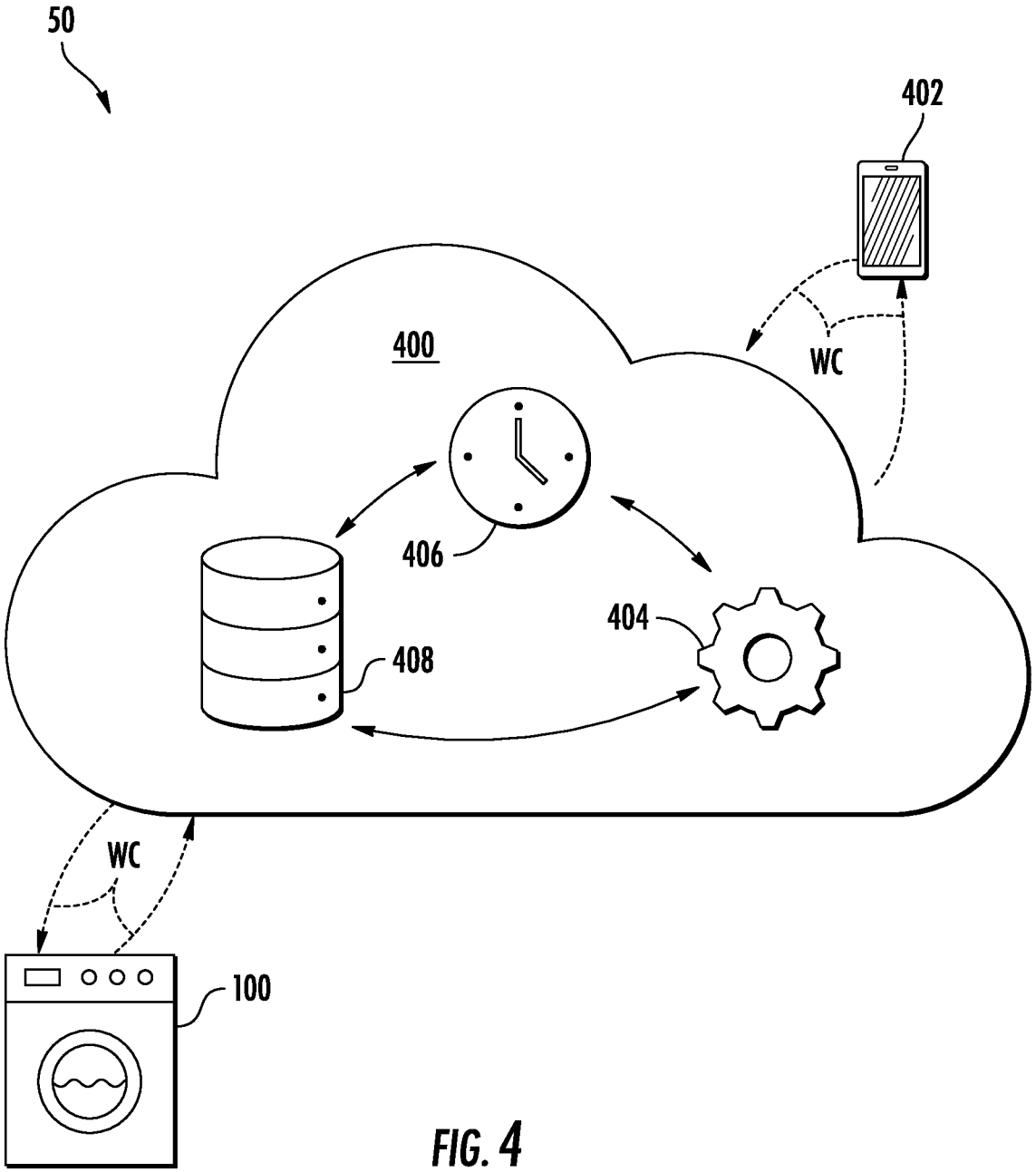
FIG. 4 provides a schematic view of an appliance control system of FIG. 1.

FIG. 4 is a schematic view of an appliance control system 50 for washing machine appliance 100 according to an example embodiment of the present subject matter. It will be understood that appliance control system 50 is not limited to any particular type of appliance but rather may be used to control any type of appliance. Generally, controller 186 of washing machine appliance 100 may be in operative communication with input selectors 182. The control panel 180 of washing machine appliance 100 may be in communication with controller 186 via, for example, one or more signal lines or shared communication busses, and signals generated in controller 186 operate washing machine appliance 100 in response to user input via input selectors 182. Input/Output ("I/O") signals may be routed between controller and various operational components of washing machine appliance 100. Thus, operation of washing machine appliance 100 can be regulated by controller 186 that is operatively coupled to the control panel 180.

Washing machine appliance 100 may be in operative communication directly or indirectly with a separate or external computing device 402. Moreover, external device 402, such as a smartphone, tablet, personal computer, etc., may be in operative communication with washing machine appliance 100 through network WC. Specifically, according to an example embodiment, network WC is configured for signal communication between washing machine appliance 100, a user via external device 402, and/or a remote server 400, e.g., a cloud-based sever. According to example embodiments, washing machine appliance 100 may communicate with external device 402 either directly (e.g., through a local area network (LAN), Wi-Fi, Bluetooth®, etc.) or indirectly (e.g., via a mesh network), as well as with remote server 400 to receive notifications, provide confirmations, input operational data, transmit sound signals and sound signatures, etc., on network WC.

In general, external device 402 may be any suitable device for providing and/or receiving communications or commands from a user. In this regard, external device 402 may include, for example, a personal phone, a tablet, a laptop computer, a smart home assistant (e.g., Google® Assistant or Amazon® Alexa) or another mobile device. In addition, or alternatively, communication between washing machine appliance 100 and the user may be achieved directly through the control panel 180 on appliance 100. In general, network WC can be any type of communication network. For example, network WC can include one or more of a wireless network, a wired network, a personal area network, a local area network, a wide area network, the internet, a cellular network, etc. In general, communication with network may use any of a variety of communication protocols (e.g., TCP/IP, HTTP, SMTP, FTP), encodings or formats (e.g. HTML, XML), and/or protection schemes (e.g., VPN, secure HTTP, SSL).

In some example embodiments, remote server 400 may be the external device 402. Thus, remote server 400, e.g., a cloud-based server, may be configured to perform various operations. For example, remote server 400 may be configured to acquire a load weight 404 measured by washing machine appliance 100. Remote server 400 may also identify a time of day 406, as well as compare a cycle history 408 of the washing machine appliance 100. Each of these operations may be considered by remote server 400, e.g., in response to the load weight 404, the time of day 406, and the cycle history 408 washing machine appliance 100 may suggest an operation mode of the washing machine appliance 100. Each of these operations may be triggered by a new wash cycle activation at the washing machine appliance 100. For example, the user may activate a new wash cycle, and in response, remote server 400 may acquire a load weight 404, identify a time of day 406, compare a cycle history 408, and suggest an operation mode of the washing machine appliance 100. The suggested operating mode may be displayed on display 184 of washing machine appliance 100. Further, the suggested operating mode may be sent to external device 402.

Moreover, the operation mode may be determined in response to the load weight 404 being less than a set weight, the time of day 406 being after a set time, and the cycle history 408 indicating a subsequent cycle is unlikely. For example, the set weight may be at most three kilograms (3 kg), and the set time may any programmable time of day programmed by the user, e.g., nine-thirty in the afternoon (9:30 pm). Further, the cycle history 408 may be a record of past cycles of the washing machine appliance 100. The record of past cycles may be stored on the memory of the external device, e.g., on remote server 400.

In other alternative embodiments, controller 186 may be configured to monitor for the new wash cycle activation, measure the load weight 404, identify a time of day 406, compare a cycle history 408 of the washing machine appliance to the new wash cycle activation, and suggest an operation mode of the washing machine appliance in response to the load weight 404, the time of day 406, and the cycle history 408. Moreover, operations may be distributed between controller 186 and external device 402. For example, controller 186 may monitor for the new wash cycle activation and measure the load weight 404 of the washing machine appliance 100, and external device 402, e.g., remote server 400, may identify a time of day 406, compare a cycle history 408, and suggest an operation mode of the washing machine appliance 100.

Figure 5:
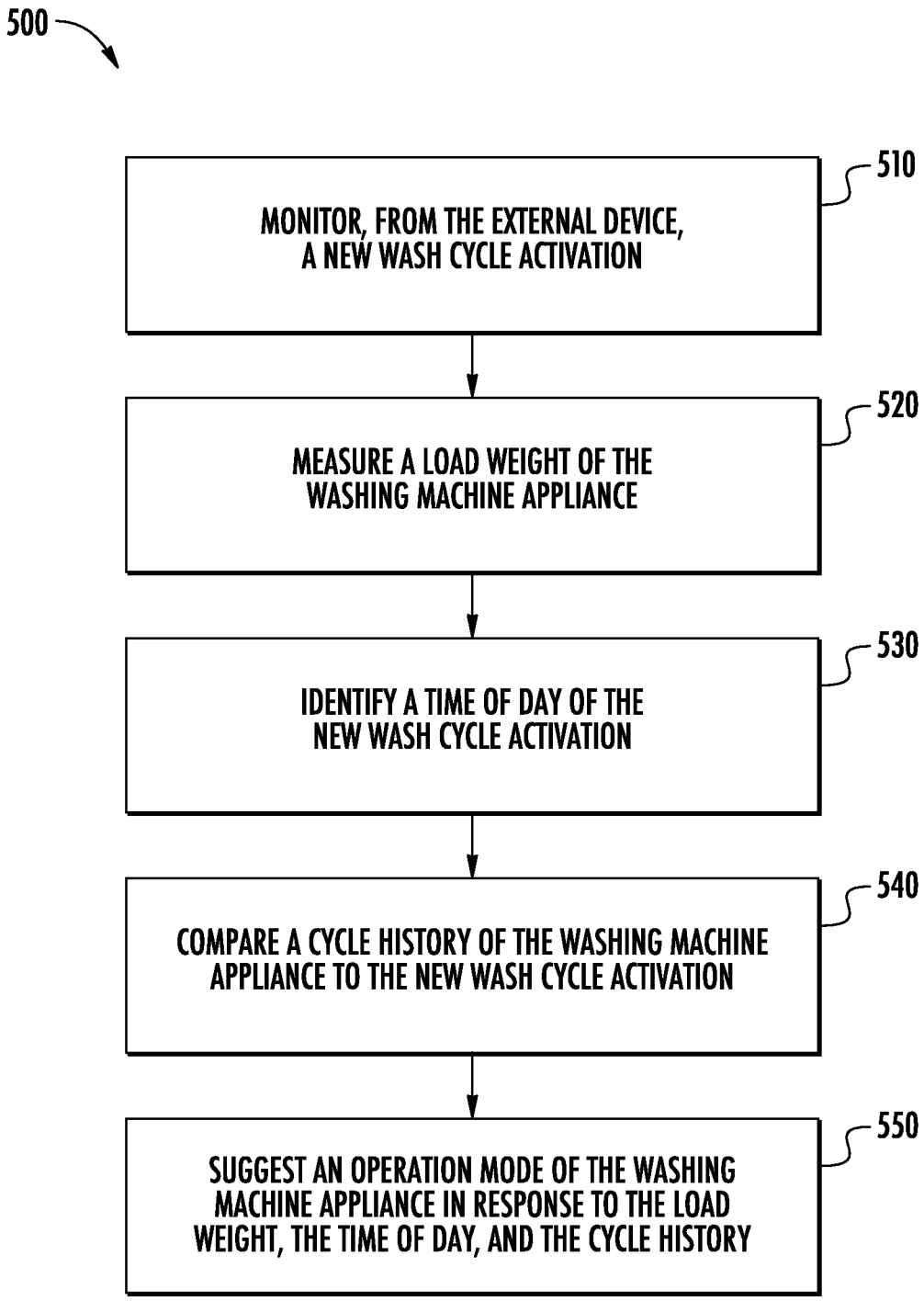
FIG. 5 provides a method of operating a washing machine appliance according to one or more example embodiments of the present disclosure.

FIG. 5 provides a method 500 of operating washing machine appliance 100 configured for signal communication with external device 402. For example, at 510 of method 500, external device 402, e.g., remote server 400, may be configured to monitor washing machine appliance 100 for the activation of a new wash cycle, e.g., operations may be triggered by the new wash cycle activation at the washing machine appliance 100. Thus, at 520 of method 500, external device 402 may be configured to acquire a load weight 404 measured by washing machine appliance 100. Further, at 530 and 540 of method 500, external device 402 may identify a time of day 406, as well as compare a cycle history 408 of the washing machine appliance 100, respectively. As stated above, each of these operations may be considered by external device 402, e.g., in response to the load weight 404, the time of day 406, and the cycle history 408, at 550 of method 500, washing machine appliance 100 may suggest an operation mode of washing machine appliance 100. For example, the user may activate a new wash cycle, which is detected at 510, and in response, remote server 400 may acquire a load weight 404 at 520, identify a time of day 406 at 530, compare a cycle history 408 at 540, and suggest an operation mode of the washing machine appliance 100 at 550.

Figure 6:
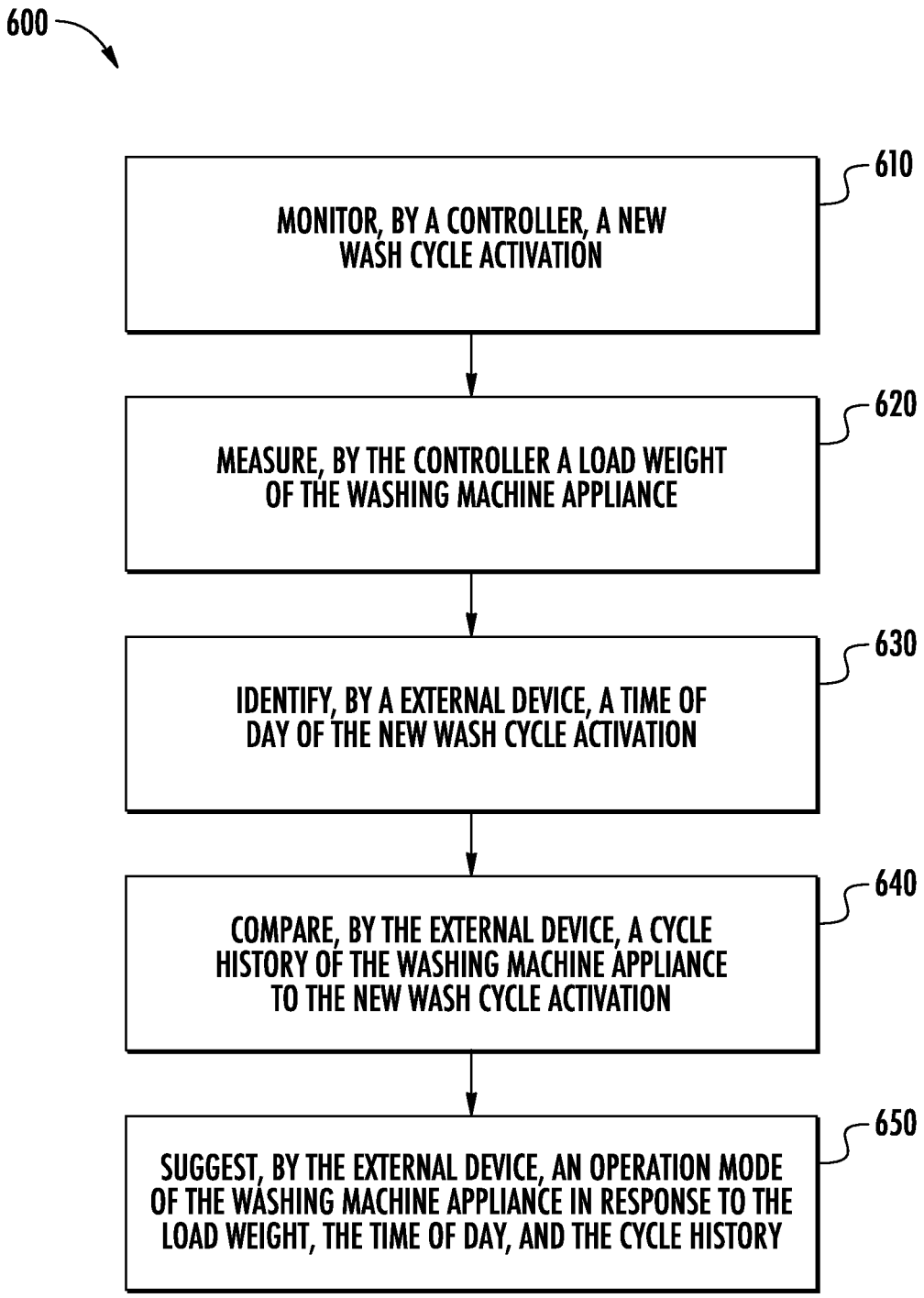
FIG. 6 provides an alternative method of operating a washing machine appliance according to one or more example embodiments of the present disclosure.

FIG. 6 provides an alternative method 600 of operating washing machine appliance 100 configured for signal communication with external device 402. In alternative embodiment method 600, local controller 186 may be configured to perform operations similar to those of method 500. For example, at 610, controller 186 may be configured to monitor for the new wash cycle activation, and at 620, measure the load weight 404. External device 402 may be configured to, at 630, identify a time of day 406, at 640, compare a cycle history 408 of the washing machine appliance to the new wash cycle activation, and at 650, suggest an operation mode of the washing machine appliance in response to the load weight 404, the time of day 406, and the cycle history 408.

FIGS. 5 and 6 depicts steps performed in a particular order for purposes of illustration and discussion. Those of ordinary skill in the art, using the disclosures provided herein, will understand that the steps of any of the methods discussed herein may be adapted, rearranged, expanded, omitted, or modified in various ways without deviating from the scope of the present disclosure. Moreover, although aspects of method 500 and method 600 are explained using appliance 100 as an example, it should be appreciated that methods 500 and method 600 may be applied to the operation of any suitable appliance.

As may be seen from the above, methods 500, 600 depict washing machine appliance 100 operation mode suggestions generated based upon the laundry load size 404, the time of doing laundry 406, and the user's historical laundry pattern 408. The suggestions may be generated from external device 402 or remote server 400 and may be activated remotely, e.g., from external device 402, by the user. As such, using particular modes and features of washing machine appliance 100 may be more convenient and intuitive to users.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a washing machine appliance, the washing machine appliance configured for communication with an external device, the method comprising:

monitoring, from the external device, a new wash cycle activation;

measuring a load weight of the washing machine appliance;

identifying a time of day of the new wash cycle activation;

comparing a cycle history of the washing machine appliance to the new wash cycle activation; and suggesting an operation mode of the washing machine appliance in response to the load weight, the time of day, and the cycle history.

2. The method of claim 1, wherein the external device is a cloud-based server.

3. The method of claim 1, wherein the operation mode is determined in response to the load weight being less than a set weight, the time of day being after a set time, and/or the cycle history indicating a subsequent cycle is unlikely.

4. The method of claim 3, wherein the set weight is no greater than three kilograms.

5. The method of claim 3, wherein the set time is a programmable time of day.

6. The method of claim 3, wherein the cycle history is a record of past cycles of the washing machine appliance.

7. The method of claim 6, wherein the record of past cycles in stored on a memory of the external device.

8. The method of claim 1, wherein the operation mode suggested is displayed on a display of the washing machine appliance.

9. The method of claim 1, further comprising sending the suggestion of the operation mode from the external device to a separate device, the separate device comprising one or more of a tablet, smart phone, and computing device configured for signal communication.

10. The method of claim 1, wherein the washing machine appliance comprises a controller configured to monitor a new wash cycle activation, measure a load weight of the washing machine appliance, identify a time of day of the new wash cycle activation, compare a cycle history of the washing machine appliance to the new wash cycle activation, and suggest an operation mode of the washing machine appliance in response to the load weight, the time of day, and the cycle history.

11. A method of operating a washing machine appliance, the washing machine comprising a controller configured for signal communication with an external device, the method comprising:

monitoring, by a controller, a new wash cycle activation;

measuring, by the controller, a load weight of the washing machine appliance;

identifying, by the external device, a time of day of the new wash cycle activation;

comparing, by the external device, a cycle history of the washing machine appliance to the new wash cycle activation; and suggesting, by the external device, an operation mode of the washing machine appliance in response to the load weight, the time of day, and the cycle history.

12. The method of claim 11, wherein the external device is a cloud-based server.

13. The method of claim 11, wherein the operation mode is determined in response to the load weight being less than a set weight, the time of day being after a set time, and/or the cycle history indicating a subsequent cycle is unlikely.

14. The method of claim 13, wherein the set weight is no greater than three kilograms.

15. The method of claim 13, wherein the set time is a programmable time of day.

16. The method of claim 13, wherein the cycle history is a record of past cycles of the washing machine appliance.

17. The method of claim 16, wherein the record of past cycles in stored on a memory of the external device.

18. The method of claim 11, wherein the operation mode being suggested is displayed on a display of the washing machine appliance.

19. The method of claim 11, further comprising sending the suggestion of the operation mode from the external device to a separate device, the separate device comprising one or more of a tablet, smart phone, and computing device configured for signal communication.

20. The method of claim 11, wherein the controller of the washing machine appliance is further configured to the identify the time of day of the new wash cycle activation, compare the cycle history of the washing machine appliance to the new wash cycle activation, and suggest the operation mode of the washing machine appliance in response to the load weight, the time of day, and the cycle history.

* * * * *